US006105764A

United States Patent [19]

Scicluna et al.

[11] Patent Number: 6,105,764

[45] Date of Patent: Aug. 22, 2000

[54] COMPUTER CARRYING CASE

[75] Inventors: Paul Victor Scicluna, Penndel, Pa.; Timm John Fenton, Lebanon, N.J.

[73] Assignee: Tumi, Inc., South Plaintfield, N.J.

[21] Appl. No.: 09/248,306

[22] Filed: Feb. 11, 1999

[51] Int. Cl.[7] ..... B65D 85/00

[52] U.S. Cl. ..... 206/320; 206/305; 206/583; 190/111

[58] Field of Search ..... 206/576, 583, 206/305, 320; 190/110–111; 150/111–117

[56] References Cited

U.S. PATENT DOCUMENTS

| | | | |
|---|---|---|---|
| 212,711 | 2/1879 | Klett | 190/111 |
| 4,339,039 | 7/1982 | Mykleby . | |
| 5,010,988 | 4/1991 | Brown | 190/111 |
| 5,160,001 | 11/1992 | Marceau | 190/111 |
| 5,217,119 | 6/1993 | Hollingsworth . | |
| 5,524,754 | 6/1996 | Hollingsworth . | |
| 5,678,666 | 10/1997 | Shyr et al. | 150/112 |
| 5,725,090 | 3/1998 | Vermillion et al. | 206/320 |

*Primary Examiner*—Paul T. Sewell
*Assistant Examiner*—J. Mohandesi
*Attorney, Agent, or Firm*—Baker Botts L.L.P.

[57] ABSTRACT

A computer carrying case has an outer receptacle with walls of flexible material joined to form a fully enclosed volume. The outer receptacle receives a computer receptacle having front and back walls that include substantially rigid panels and that are coupled together at the ends by devices that permit the width of the computer receptacle between the front and back walls to be adjusted so that laptop computers of different thicknesses can be accommodated reasonably snugly.

19 Claims, 10 Drawing Sheets

COMPUTER CARRYING CASE

BACKGROUND OF THE INVENTION

The rapidity of improvements over the years in computer technology has led to equally rapid changes in the sizes of laptop computers. For some time from the early days of laptop computers, the tendency was to reduce the size as much as possible, leading to a proliferation of "notebook" computers. More recently, the performance capability of laptop computers in terms of processor speeds, data storage capacity, ability to incorporate CD-ROM drives, and improved flat screen displays, has resulted in a return to relatively large-size portable computers. Currently, therefore, portable computers are produced in a relatively wide range of sizes.

A virtually indispensable accessory for a portable computer is a carrying case. Although some users prefer a carrying case that is dedicated to a particular computer and has a compartment dimensioned to match the computer and hold it securely, many users like to carry their computer in a carrying case that has compartments for documents and other articles. Computer carrying cases that double as briefcases—i.e., briefcases with a compartmented main receptacle and with a computer receptacle—are widely available. Backpacks with computer receptacles have also become popular, especially with students. Generally, the computer compartments of briefcases and backpacks are sized to receive the largest available computers. Consequently, if a user has a relatively small computer, the computer is received loosely in the compartment and is prone to rocking from side to side or sliding from end to end. End-to-end sliding is commonly prevented by including a padded adjustable insert that is attached by hook and loop cloth in an adjusted position so that the end-to-end length of the computer receptacle can be adjusted by the user to accept his or her computer. To date there has been no provision made in carrying cases with computer receptacles to adjust the size of the computer receptacle in the direction of the thickness of the receptacle. Accordingly, thin computers can rock in the thickness direction, which results in disconcerting shifting of the load. Is the case of a shoulder-carried bag, a sudden rocking of the computer in the thickness direction away from the person's body can dislodge the bag from the person's shoulder and allow it to fall to the ground.

BRIEF SUMMARY OF THE INVENTION

An object of the present invention is to provide a computer carrying case in which the thickness of a computer receptacle can be adjusted. It is also an object to retain previously known features of computer receptacles that ensure protection of the computer, that make the case useful for holding documents, computer accessories, and other articles in an organized manner, and that facilitate handling and carrying the case. Yet another object is to enhance the versatility of a carrying case with a computer receptacle without significantly increasing the complexity of its construction or the cost of manufacture.

The foregoing objects are attained, in accordance with the present invention, by a computer carrying case that has a main outer receptacle having walls of a flexible material, namely a front side wall, a rear side wall, a right end wall joining the right ends of the front side wall and the rear side wall, a left end wall joining the left ends of the front side wall and the rear side wall, a bottom wall joined to bottom edges of the front side wall, the rear side wall, the right end wall and the left end wall, and a top wall joined to top edges of the front side wall, the rear side wall, the right end wall and the left end wall. The main receptacle receives a computer receptacle, which has a front wall and a rear wall, each of which includes a panel of a substantially rigid sheet material, a right wall joining right ends of the front wall and the rear wall, and a left wall joining left ends of the front wall and the rear wall, the right wall and left wall being of a flexible sheet material. Provision is made for adjustably connecting the right ends of the front wall and the rear wall to each other and the left ends of the front wall and the rear wall to each other so as to enable the spacing between the front wall and rear wall to be varied.

A carrying case embodying the present invention permits adjustment of the size of the computer receptacle in the thickness direction of the computer by a variety of specific adjusting elements, some of which are described below, that are both simple and effective and that do not significantly increase the complexity or cost of the construction of the case. In that regard, use is made of the presence of substantially rigid panels as parts of the front and back walls of the computer receptacle. The rigid panels enable the thickness of the computer receptacle to be adjusted by elements located exclusively at each end of the computer receptacle. Therefore, the adjusting elements are located unobtrusively and do not interfere with or intrude into the compartments of the case between the computer receptacle and the front side and back side walls of the main receptacle. Also, the adjusting elements are located entirely within the main receptacle, where they are protected from loosening or releasing as a result, for example, of catching on a foreign object.

As mentioned above, there are numerous suitable devices for adjustably connecting the right and left ends of the front and rear walls to each other. One arrangement includes at each of the right and left ends a zippered gusset joining the front and rear walls. In a preferred construction of a zippered gusset, there is a pair of strips of flexible material, one of which is joined along one edge to the end of the front wall and the other of which is joined along one edge to the end of the rear wall. A zipper releasably joins the other edges of each strip to each other. Advantageously, each of the strips forming the zippered gusset has a lower edge that is fastened to the end wall of the computer receptacle in spaced-apart relation to the lower edge of the end wall, and a lower portion of each strip is wider than an upper portion so that when the zipper is released, the lower portion of the compartment expands to substantially the same extent as the upper portion.

Other forms of devices for adjustably connecting the ends of the side walls to each other include the following:

- a flexible tab joined to each end of each of the front and rear walls intermediate the top and bottom edges of the front and rear walls and a releasable fastener having one coupling element on two of the tabs and the other coupling element on the remaining two tabs;
- a flexible strip member joined to each end of the rear wall intermediate the top and bottom edges of the rear wall, one coupling element of a releasable fastener, such as hook and loop cloth, affixed to each of the strip members, and the other element of the releasable fastener affixed to the front wall of the computer receptacle;
- a flexible cord at each of the right and left ends trained along a predetermined path in coupled relation to the front and rear walls;
- a buckle on each end of the front wall and a tab on each end of the rear wall that is releasably engageable with the buckle in a plurality of selected positions.

In some embodiments, the top wall and the right and left end walls of the main receptacle may include a continuous releasable closure, such as a zipper. In such configurations, the main receptacle includes at each end an end gusset substantially coextensive with and joining the ends of the front and rear side walls. A portion of each end gusset forms a respective right end and left end wall of the computer receptacle.

In particularly preferred constructions, the computer receptacle includes a sling formed by a loop of a flexible elastic material received between the front and rear walls and having a front edge joined to the front wall along a juncture parallel to the top edge of the front wall and a rear edge joined to the rear wall along a juncture parallel to the top edge of the rear wall. The sling is suspended freely from the junctures in dependent relation and has a lower extremity spaced apart above bottom edges of the panels of the front and rear walls so as to enable elastic displacement of the sling toward the bottom wall of the main receptacle. Such a sling, which is known per se, in combination with rigid panels as parts of the front and rear walls greatly reduces the chance of damage to the computer if the carrying case is dropped by elastically extending and thereby reducing the deceleration of the computer due to its inertia when the case impacts the ground. The rigid panels accept the impact and keep the computer from hitting the ground.

The computer receptacle can be constructed and fitted to be removable from the main receptacle of the case. The carrying case can be configured to be hand carried by providing handles, to be carried as a shoulder bag by providing a shoulder strap, or to be carried on a person's back by providing shoulder straps. The present invention is also applicable to carrying cases in the form of suitcases, which may have wheels and towing handles. In any form the case can include compartments on the outside of the main receptacle, inside compartments and envelopes, such as for floppy discs, CD ROM's, batteries, cords, and other accessories for the computer, and organizers for tickets, passports, checkbooks, and pens. Generally, compartments between the front side and rear side walls of the main receptacle and the front and rear walls of the computer receptacle will be for documents.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENTS

Figure 1:
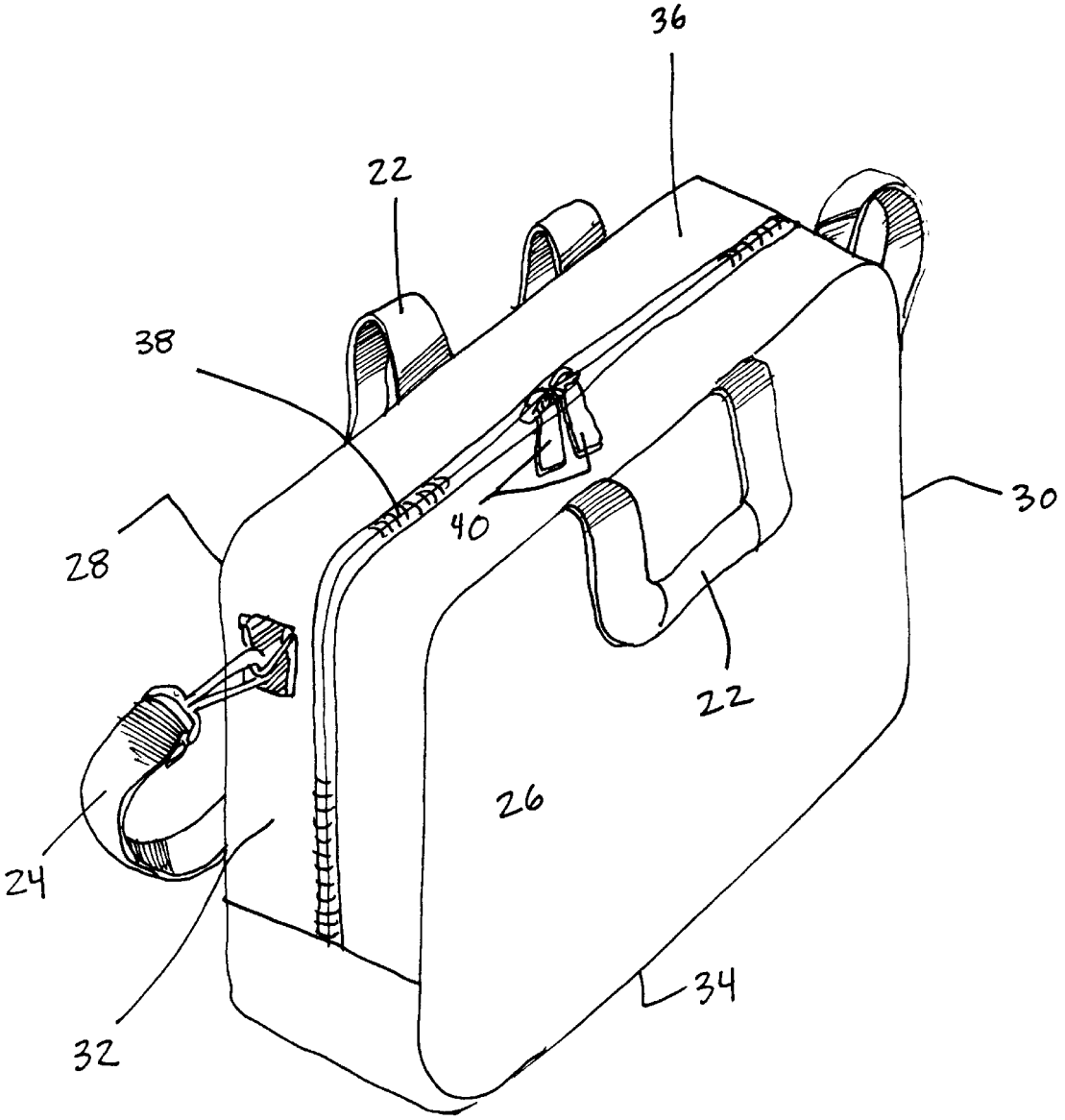
FIG. 1 is a three-quarter front pictorial view of a first embodiment.
Figure 2:
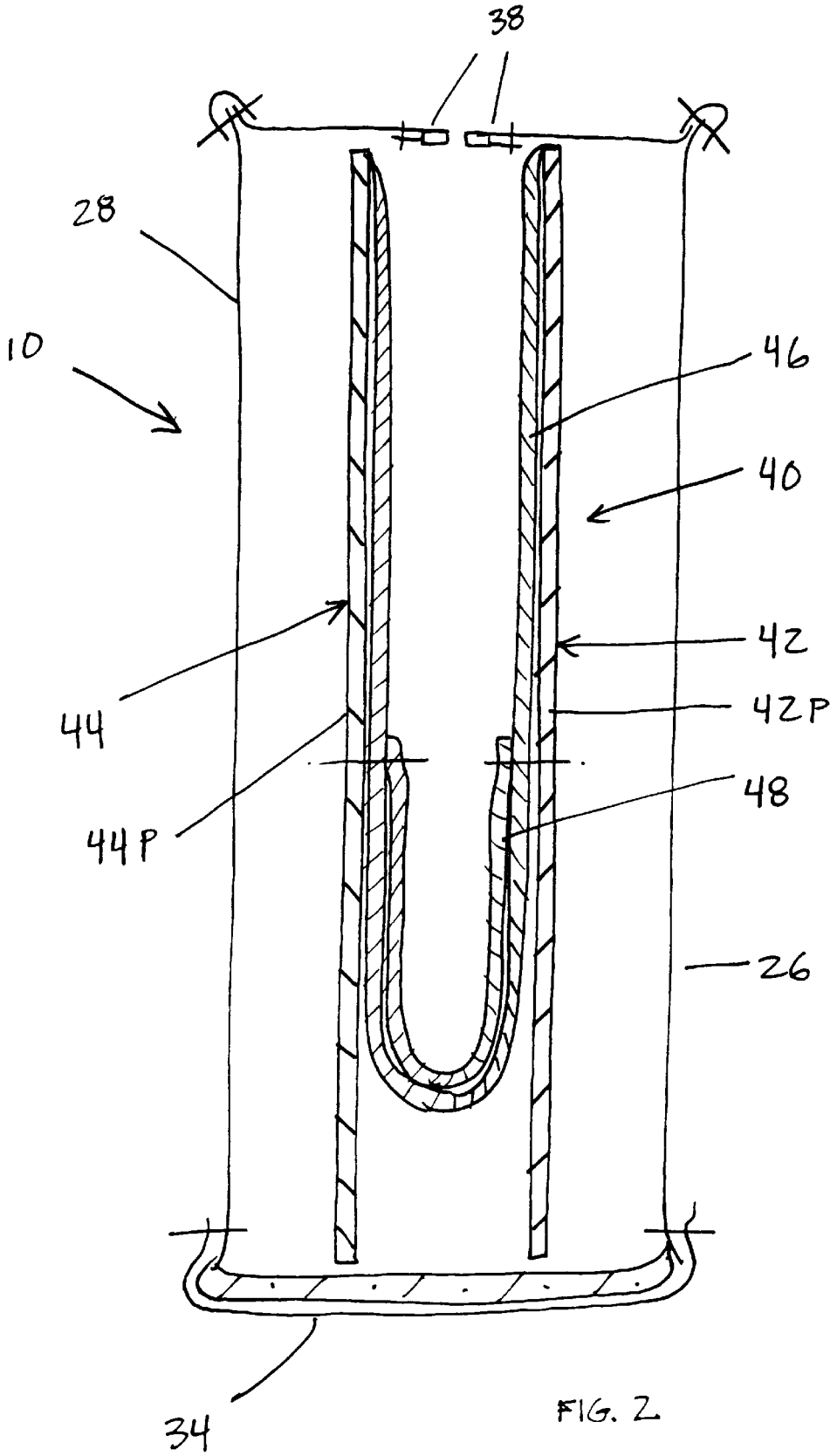
FIG. 2 is a simplified, schematic end cross-sectional view of the first embodiment.

All embodiments of the present invention have a main receptacle, such as the receptacle 20 shown in FIG. 1. As mentioned above, the size and shape of the main receptacle and the fittings associated with the main receptacle may vary in order to adapt the main receptacle for use as a hand- and/or shoulder-carried briefcase, as shown in FIG. 1, a backpack or a suitcase. The main receptacle 20 of FIG. 1 has handles 22 and a detachable shoulder strap 24. The main receptacle is defined by a front side wall 26, a rear side wall 28, a right end wall 30 joining the right ends of the front side wall and the rear side wall, a left end wall 32 joining the left ends of the front side wall and the rear side wall, a bottom wall 34 joined to the bottom edges of the front side wall, the rear side wall, the right end wall and the left end wall, and a top wall 36 joined to top edges of the front side wall, the rear side wall, the right end wall and the left end wall. The walls of the main receptacle are made of a durable, flexible sheet material, such as a woven fabric or natural or synthetic leather. A zipper 38 with two closure elements 40 extends continuously along the centers of the top wall 36 and the end walls 30 and 32 and when unzipped provides access to the main receptacle. The ends of the zippers are located a short distance from the bottom wall 34, as shown in FIG. 1.

The main receptacle 20 contains a computer receptacle 40 which consists of a front wall 42 and a rear wall 44, the left and right ends of which are joined to left and right end gussets of the main receptacle (described further below). The front and rear walls 42 and 44 are substantially coextensive in width and height with the front side and rear side walls of the main receptacle and include a panel 42P, 44P of a substantially rigid sheet material, such as a durable, rigid polymeric material, fiberboard, metal, or a fiber-reinforced polymeric material. The rigid panel is encased within a fabric cover.

A sheet 46 of an elastomeric material, such as neoprene, formed into a loop, is secured to each of the side walls 42 and 44 at or near the upper edges. A second sheet 48 of the same or a similar elastomeric material, which is also formed into a loop, is received within the lower portion of the sheet 46 and fastened, such as by stitching 50, to the side walls 42 and 44. The sheets 46 and 48 constitute a shock-absorbing sling, which supports the computer with its lower end cradled in the lower loop portion and located some distance from the bottom wall 34 of the main receptacle 10. If the case is dropped, the bottom edges of the side walls 42 and 44 receive the impact. The rigid panels 42P and 44P prevent the computer receptacle from being compressed or partially crushed vertically by the impact. The lower loop portions of the elastomeric sheets 46 and 48 extend under the inertial force of the computer, reducing the force exerted on the computer by deceleration just after impact of the bottom of the case. The elastic sling of the embodiment is known per se from its use in computer cases currently being marketing by Tumi, Inc., the assignee of the present invention. U.S. Pat. Nos. 5,217,119 (Hollinsworth, 1993) and 5,524,754 (Hollinsworth, 1996), which describe and show elastic slings for cases for electronic equipment, are hereby incorporated herein for all purposes.

Figure 3:
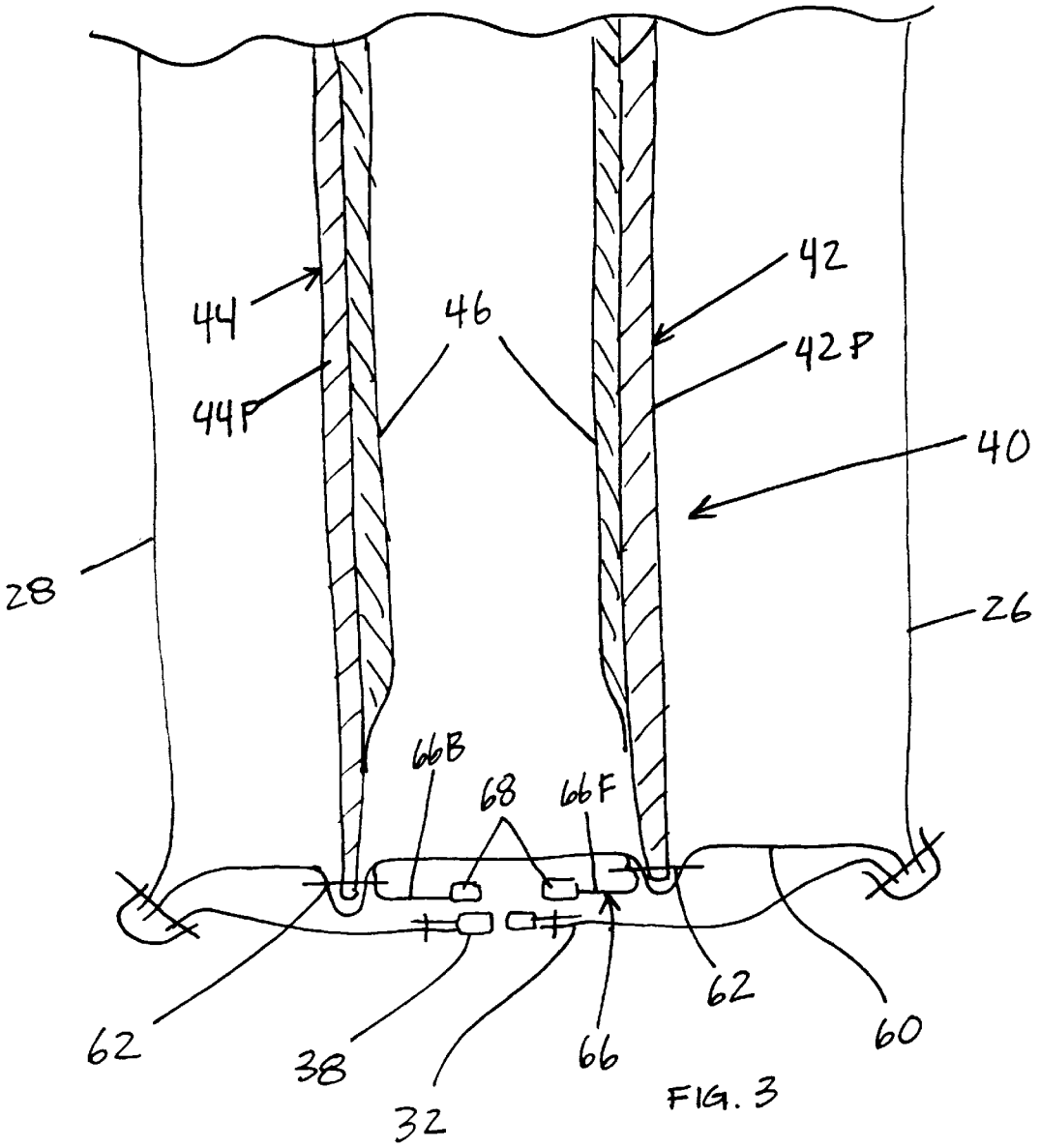
FIG. 3 is a simplified, schematic, partial top cross-sectional view of the first embodiment.

Referring next to the partial, generally schematic top cross-sectional view of FIG. 3, the main receptacle includes at each end an end gusset 60, which lies inwardly of and is coextensive with the end wall 30 or 32, as the case may be. The left and right ends of the front wall and back wall 42 and 44 of the computer receptacle 40 are secured by stitching 62 to the gusset, leaving spaces between the walls 42 and 44 and the side walls 26 and 28 so as to provide compartments on opposite sides of the computer receptacle for documents and other articles.

Figure 4:
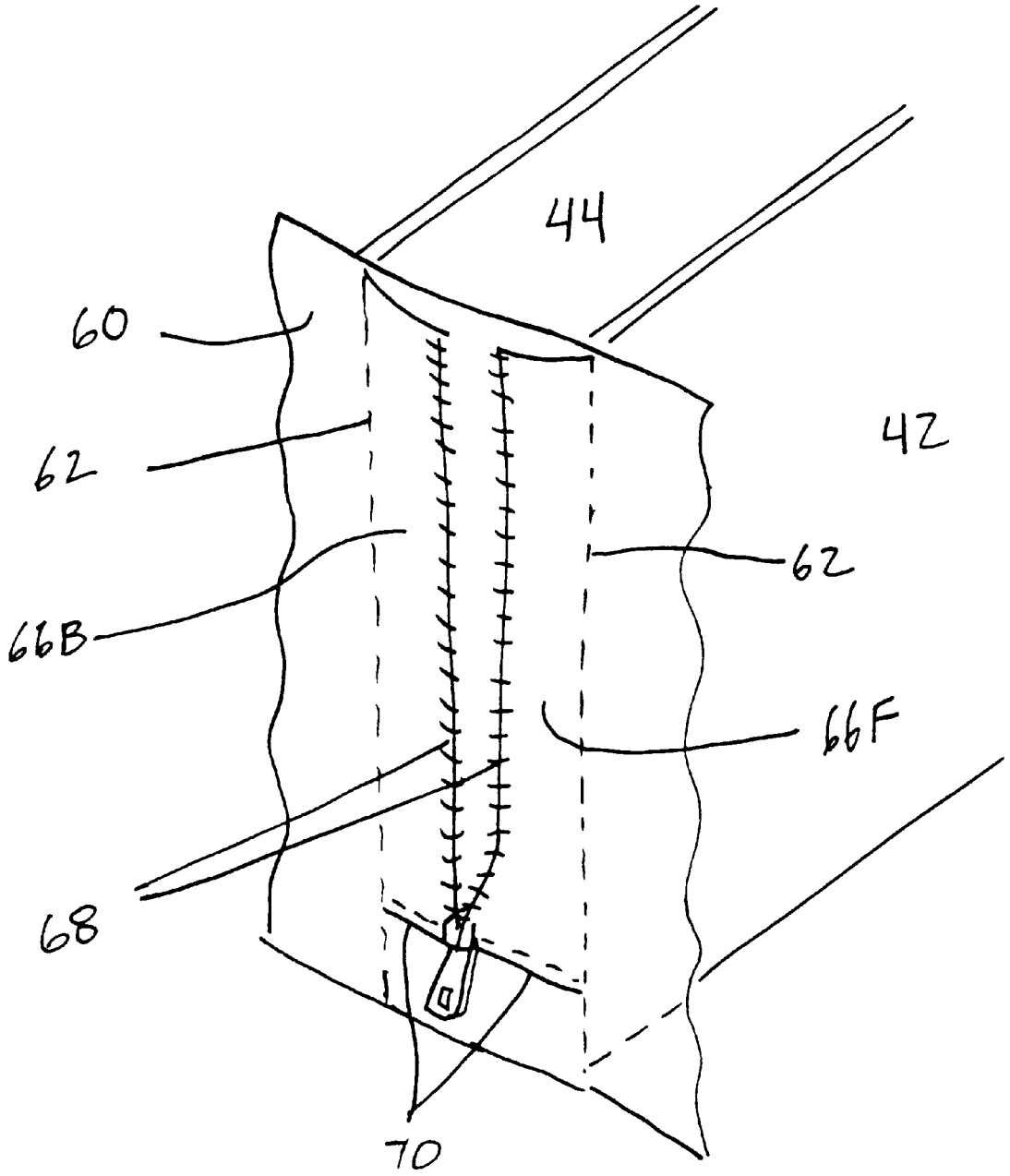
FIG. 4 is a partial three-quarter pictorial view of the first embodiment, portions being broken away and the computer compartment being shown in an extended configuration.
Figure 5:
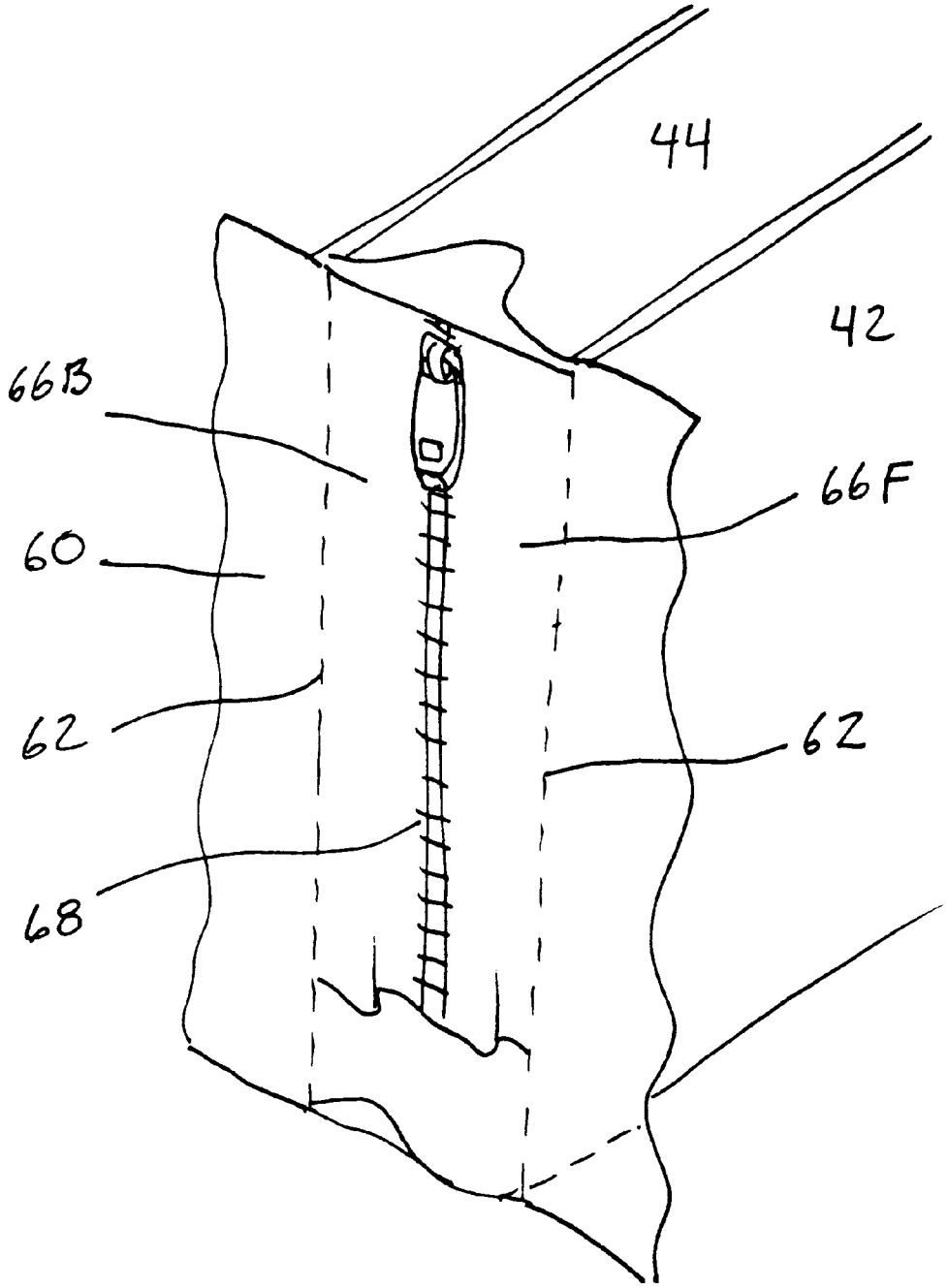
FIG. 5 is a partial three-quarter pictorial view of the first embodiment, portions being broken away and the computer compartment being shown in a retracted configuration.

In order to adjust the width of the computer receptacle 40, a zippered gusset 66 connects the left ends of the front and back walls 42 and 44 to each other. A corresponding zippered gusset connects the right ends of the front and back walls. The zippered gusset consists of strips 66B and 66F of fabric, each of which is fastened along one edge to one of the walls 42 or 44 by the stitching 62 and has a zipper 68 along the other edge. As may be seen in FIG. 4, lower edges of the strips 66B and 66F are stitched to the gusset 60 by stitching 70. The lower end of the zippered gusset 66 is located at or slightly above the lower end of the zipper 38 of the main receptacle (see FIG. 1) so as to be accessible when the zipper 38 is unzipped. The lower portions of the strips 66B and 66F are tapered so as make the zippered gusset 66 wider in the lower portion than in the upper portion. Accordingly, when the zipper 68 is unzipped (FIG. 4), the lower portion of the zippered gusset can extend to the same width as the upper portion. When the zipper 68 is fastened (FIG. 5), the width of the computer receptacle 40 is reduced.

Figure 6:
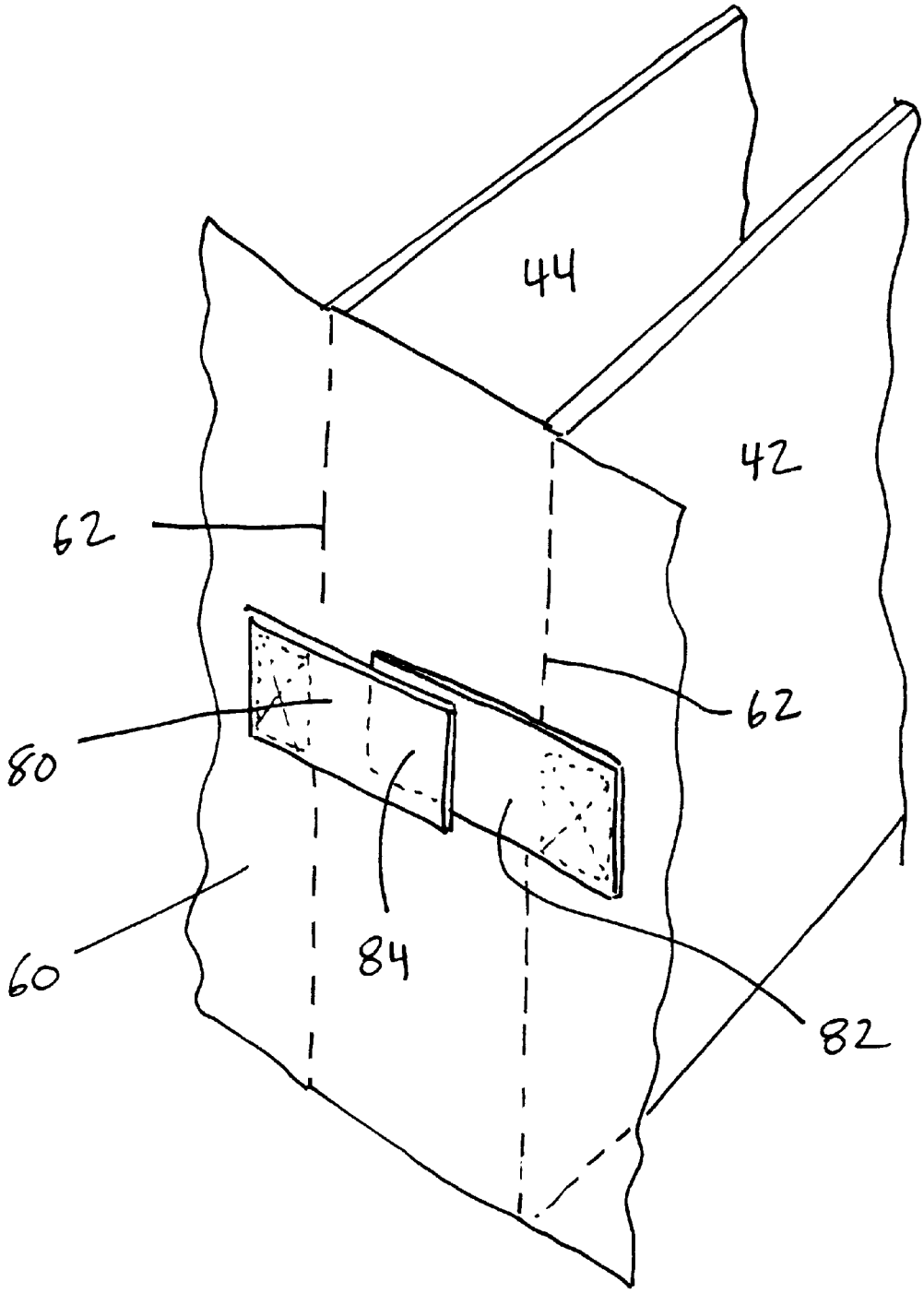
FIG. 6 is a partial three-quarter pictorial view of a second embodiment, portions being broken away and the computer compartment being shown in an extended configuration.
Figure 7:
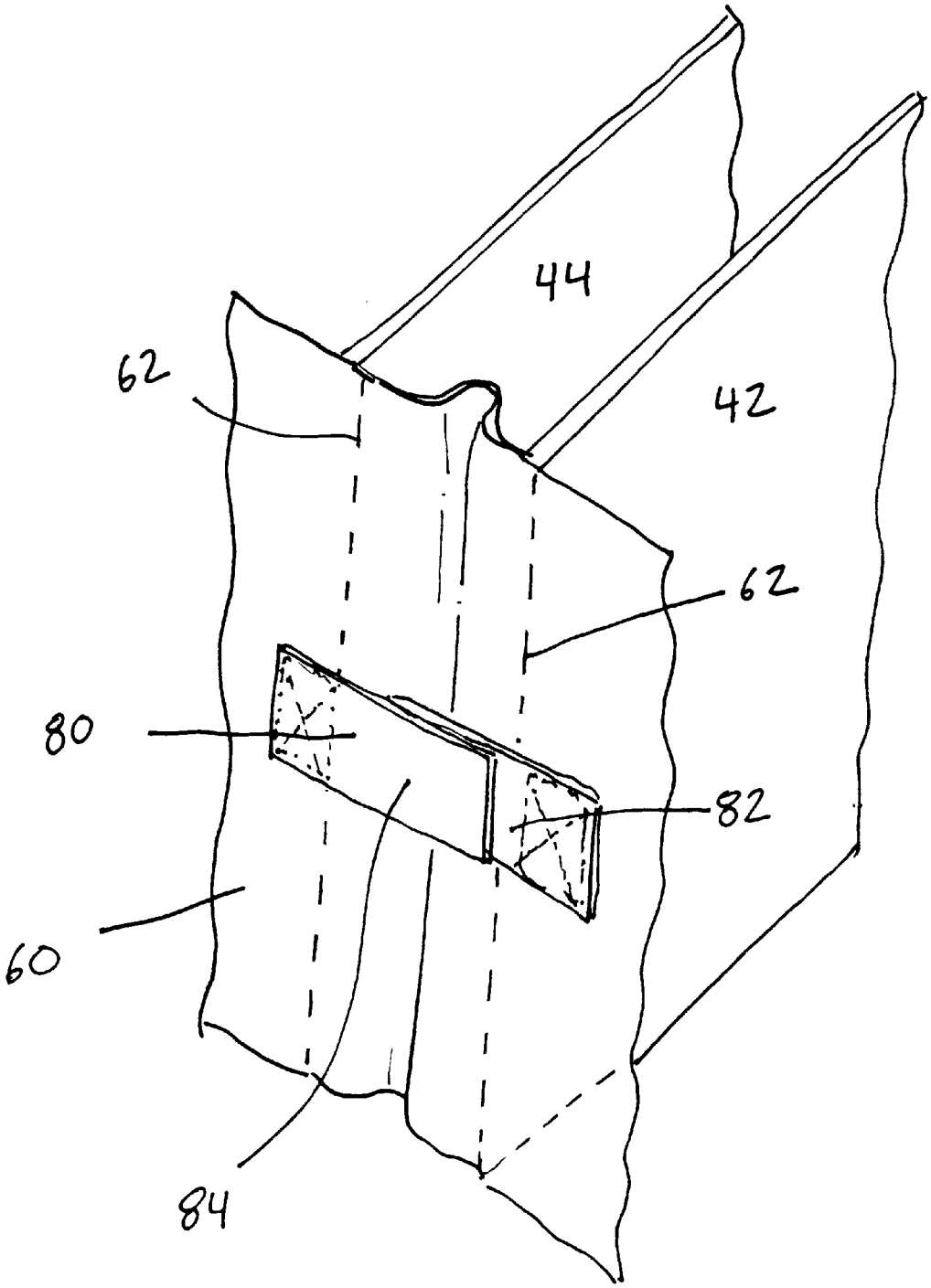
FIG. 7 is a partial three-quarter pictorial view of the second embodiment, portions being broken away and the computer compartment being shown in a retracted configuration.

A zippered gusset is only one of many possible ways of adjustably connecting the right ends of the front wall and the rear wall to each other and the left ends of the front wall and the rear wall to each other so as to enable the spacing between the front wall and rear wall to be varied. Some of the other possibilities are shown in the drawings, as follows:

FIGS. 6 and 7. Webbing strips 80 and 82 are stitched to the gusset 60 on opposite sides of the side walls 42 and 44 of the computer receptacle approximately midway between the bottom of the shock-absorbing sling and the top edges of the walls 42 and 44. The free ends of the straps overlap, and the overlapping portions 84 have a suitable releasable fastener, such as hook and loop cloth or snaps, that enables them to be secured in two or more positions with different degrees of overlap. Strips with adjustable fasteners are, of course, provided at both the right and left ends of the computer receptacle 40.

Figure 8:
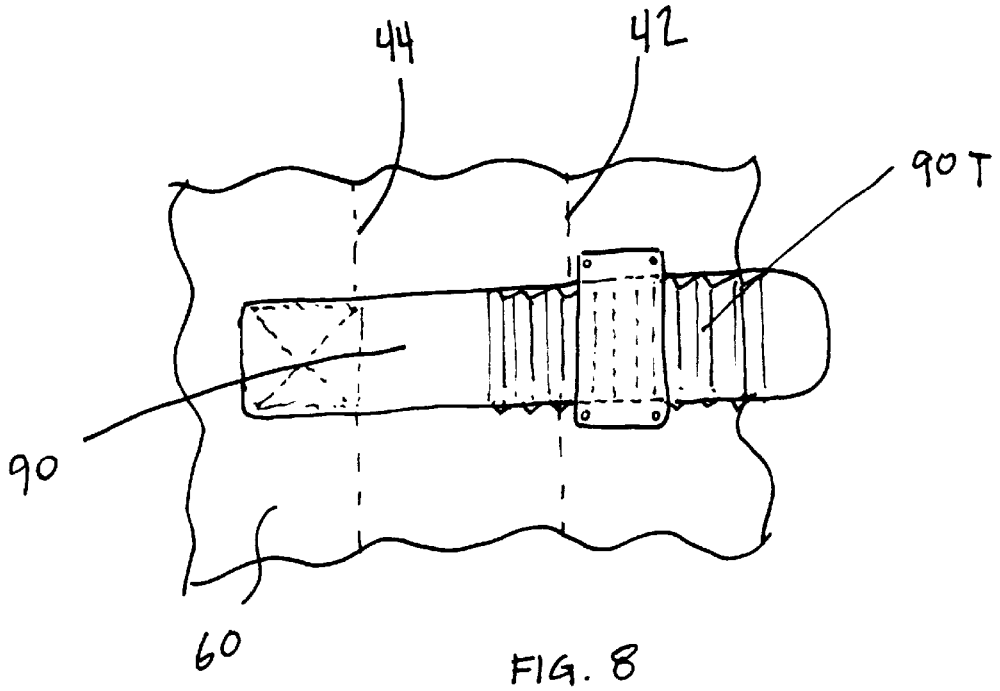
FIG. 8 is a partial end elevational view of a third embodiment, portions being broken away.

FIG. 8. A flexible tongue 90 is fastened to the gusset 60 adjacent the back wall 44 approximately midway between the bottom of the shock-absorbing sling and the top edges of the walls 42 and 44. The free end of the tongue 90 is accepted in a buckle 92 that is affixed to the gusset adjacent the front wall 42. The tongue may be of the type that has ratchet teeth 90T, each of which is engageable with a shoulder on the buckle 92. Other forms of coupling between the tongue and buckle, such as a fixed headed stud or a pivotable arm (like a belt buckle) on the buckle that engage one of several holes in the tongue or a cinch bar on the buckle that clamps a loop of a flexible tongue, can be substituted for the ratchet type buckle tongue shown in FIG. 8.

Figure 9:
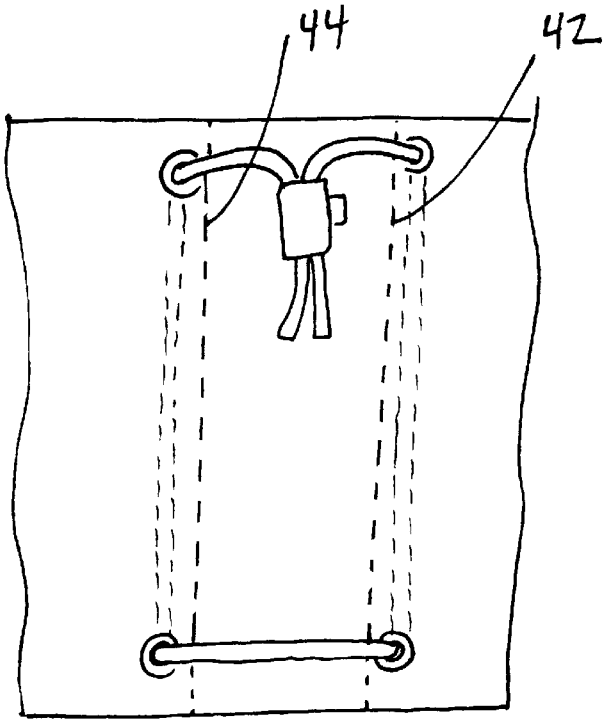
FIG. 9 is a partial end elevational view of a fourth embodiment, portions being broken away.

FIG. 9. A flexible cord 100 is trained through grommets 102 installed in the gusset 60 adjacent the front and back walls 42 and 44 near the lower end of the shock-absorbing sling and the top edges of the walls 42 and 44. The ends of the cord 100 are received by a barrel spring clamp 104, which holds the cord 100 to any adjusted length.

Figure 10:
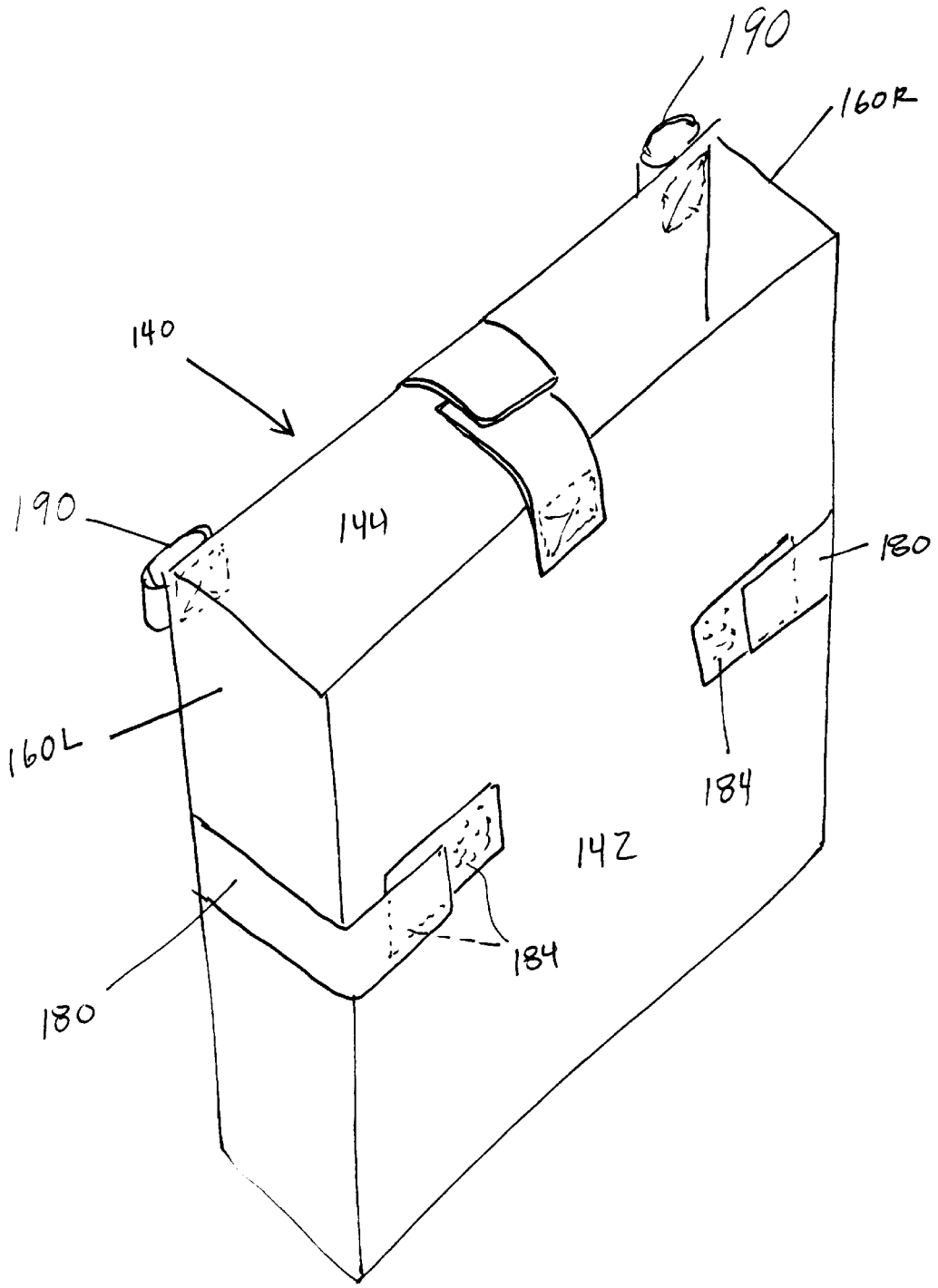
FIG. 10 is a partial three-quarter pictorial view of the fourth embodiment, the computer compartment being self contained for removal from a main receptacle and being shown in a retracted configuration.
Figure 11:
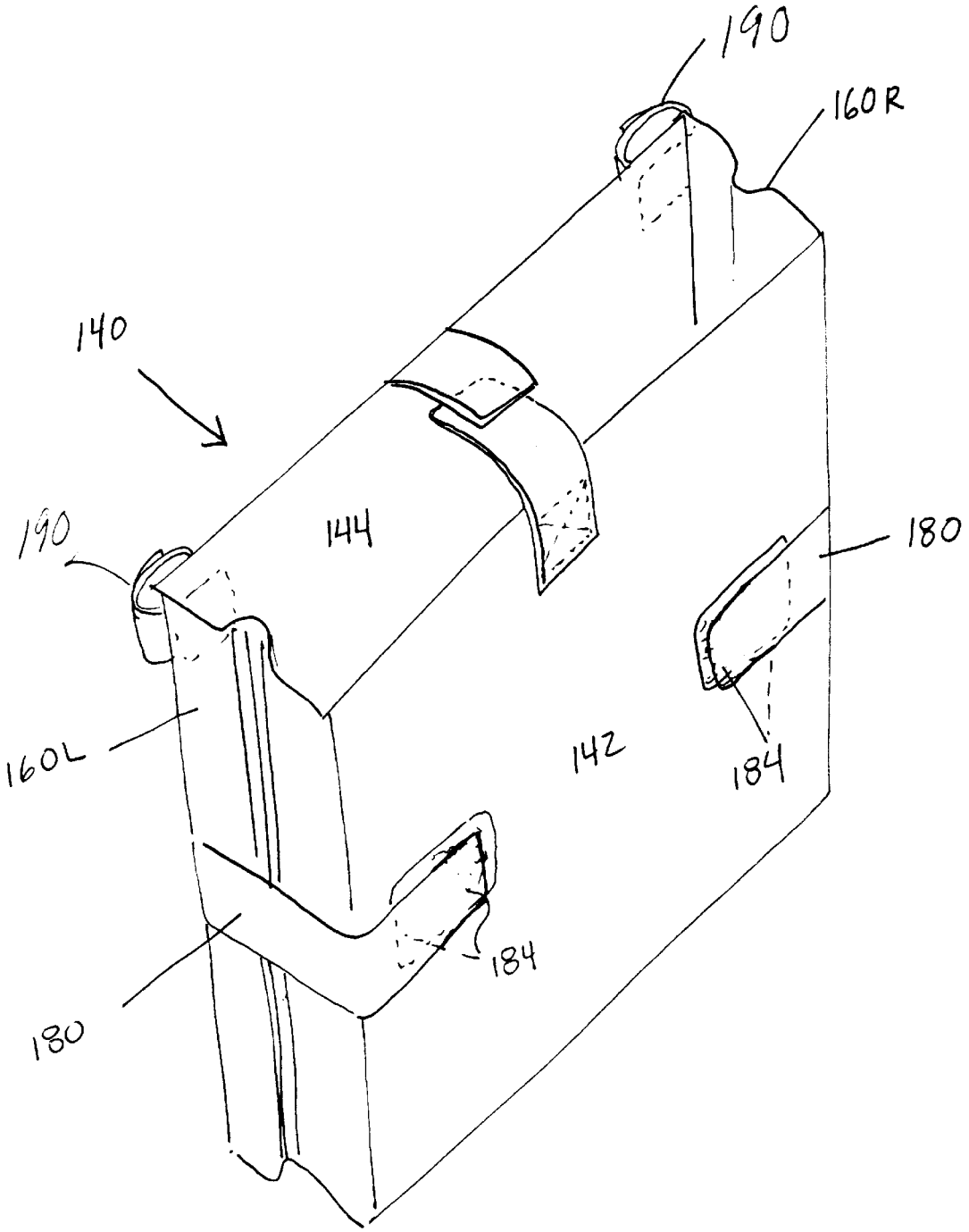
FIG. 11 is a partial three-quarter pictorial view of a fourth embodiment, the computer compartment being shown in an extended configuration.

FIGS. 10 and 11. These figures show a self-contained computer receptacle 140, which is removable from a main receptacle (not shown). It consists of front and rear walls 142 and 144 and a shock-absorbing sling of the same construction as the walls 42 and 44 and sling 46, 48 (not shown) described above. The ends of the walls 142 and 144 are joined by gussets 160L and 160R, each of which has a width that enables the receptacle 140 to receive the thickest laptop computers likely to be in current use. Webbing strips 180 are joined, such as by stitching, to the outside rear face of the back wall 144 about midway between the lower end of the shock-absorbing sling and the upper end of the receptacle. The free ends of the webbing strips lead across the end of the receptacle 140 and fold inwardly toward each other so that the end portions overlie the front surface of the front wall 142. Suitable adjustable fasteners are provided for joining the free ends of the webbing strips to the front wall 142 of the receptacle 140. The drawings illustrate patches 184 of hook and loop cloth as fasteners. Any of the fasteners described above can be adapted to the embodiment of FIGS. 10 and 11. Hook and loop cloth loops 190 detachably connect the computer receptacle 140 to D-rings (not shown) fastened to a wall of a main receptacle (not shown) so as to secure the computer receptacle 140 to the main receptacle.

What is claimed is:

1. A computer carrying case comprising a main receptacle having walls of a flexible material, including a front side wall, a rear side wall, a right end wall joining right ends of the front side wall and the rear side wall, a left end wall joining left ends of the front side wall and the rear side wall, a bottom wall joined to bottom edges of the front side wall, the rear side wall, the right end wall and the left end wall, a top wall joined to top edges of the front side wall, the rear side wall, the right end wall and the left end wall, and a zippered access opening to the main receptacle extending continuously along the top wall and at least portions of the end walls; and a computer receptacle received in the main receptacle, the computer receptacle having a front wall and a rear wall, each of which includes a panel of a substantially rigid sheet material and is spaced apart from the side walls of the main receptacle, a right wall joining right ends of the front wall and the rear wall, a left wall joining left ends of the front wall and the rear wall, the right wall and left wall being of a flexible sheet material and having portions joined to the ends of the side walls of the main receptacle, such portions forming the sole connection between at least one of the front and rear walls of the computer receptacle and the main receptacle, and means for adjustably connecting the right ends of the front wall and the rear wall to each other and the left ends of the front wall and the rear wall to each other so as to enable the spacing between the front wall and rear wall of the computer receptacle to be varied, the upper and lower edges of said at least one of the front and rear walls being free of attachments so as to permit displacements thereof relative to the top and bottom walls of the main receptacle upon such variation in the spacing.

2. The computer carrying case according to claim 1 wherein the means for adjustably connecting the right and left ends of the front and rear walls to each other includes at each of the right and left ends a zippered gusset joining the front and rear walls.

3. The computer carrying case according to claim 2 wherein each zippered gusset includes a pair of strips of flexible material, one of which is joined along one edge to the end of the front wall and the other of which is joined along one edge to the end of the rear wall, and a zipper releasably joining the other edges of each strip to each other.

4. The computer carrying case according to claim 2 wherein each of the strips has a lower edge that is fastened to the end wall of the computer receptacle in spaced-apart relation to the lower edge of the end wall and a lower portion of each strip is wider than an upper portion so that when the zipper is released the lower portion of the compartment expands to substantially the same extent as the upper portion.

5. The computer carrying case according to claim 1 wherein the means for adjustably connecting the ends of the side walls to each other includes a flexible tab joined to each end of each of the front and rear walls intermediate the top and bottom edges of the front and rear walls and a releasable fastener having one coupling element on two of the tabs and another coupling element on the remaining two tabs.

6. The computer carrying case according to claim 1 wherein the means for adjustably connecting the ends of the side walls to each other includes a flexible strip member joined to each end of the rear wall intermediate the top and bottom edges of the rear wall, one coupling element of a releasable fastener affixed to each of the strip members, and the other element of the releasable fastener affixed to the front wall of the computer receptacle.

7. The computer carrying case according to claim 6 wherein the releasable fastener is hook and loop cloth.

8. The computer carrying case according to claim 1 wherein the means for adjustably connecting the left and right ends of the front and rear walls to each other includes at each of the right and left ends a flexible cord trained along a predetermined path in coupled relation to the front and rear walls.

9. The computer carrying case according to claim 1 wherein the means for adjustably connecting the right and left ends of the front and back walls to each other includes at each end a buckle on one of the front and rear walls and a tab on the other of the front and rear walls that is releasably engageable with the buckle in a plurality of selected positions.

10. The computer carrying case according to claim 1 wherein the top wall and the right and left end walls of the main receptacle include a continuous releasable closure and the main receptacle includes at each end an end gusset substantially coextensive with and joining the ends of the front and rear side walls, and a portion of each end gusset forms a respective right end and left end wall of the computer receptacle.

11. The computer carrying case according to claim 1 wherein the computer receptacle includes a sling formed by a loop of a flexible elastic material received between the front and rear walls and having a front edge joined to the front wall along a juncture parallel to the top edge of the front wall and a rear edge joined to the rear wall along a juncture parallel to the top edge of the rear wall, the sling being suspended freely from the junctures in dependent relation and having a lower extremity spaced apart above bottom edges of the panels of the front and rear walls so as to enable elastic displacement of the sling toward the bottom wall of the main receptacle.

12. A computer carrying case comprising a main receptacle having walls of a flexible material, including a front side wall, a rear side wall, a right end wall joining right ends of the front side wall and the rear side wall, a left end wall joining left ends of the front side wall and the rear side wall, a bottom wall joined to bottom edges of the front side wall, the rear side wall, the right end wall and the left end wall, and a top wall joined to top edges of the front side wall, the rear side wall, the right end wall and the left end wall, the top and at least portions of the right end and left end walls having a continuous zippered closure and the main outer receptacle further having a right end gusset of flexible material joining the right ends of the front and rear side walls and a left end gusset of flexible material joining the left ends of the front and rear side walls, each end gusset being within the end wall and being substantially coextensive therewith, and a computer receptacle received in the main receptacle, the computer receptacle having a front wall and a rear wall, each of which includes a panel of a substantially rigid sheet material and is spaced apart from the side walls of the main compartment, and a left end and a right end, the right end of the front wall being joined to the right end gusset and the left end of the front wall being joined to the left end gusset, the right end of the rear wall being joined to the right end gusset and the left end of the rear wall being joined to the left end gussets the gussets being the sole attachments between at least one of the front and rear walls of the the computer receptacle and the main compartment, and means for adjustably connecting the right ends of the front wall and the rear wall to each other and the left ends of the front wall and the rear wall to each other so as to enable the spacing between the front wall and rear wall of the computer receptacle to be varied, the upper and lower edges of said at least one of the front and rear walls being free of attachments so as to permit displacements thereof relative to the top wall and bottom wall of the main compartment upon such variation in the spacing.

13. The computer carrying case according to claim 10 wherein the computer receptacle includes a sling formed by a loop of a flexible elastic material received between the front and rear walls and having a front edge joined to the front wall along a juncture parallel to the top edge of the front wall and a rear edge joined to the rear wall along a juncture parallel to the top edge of the rear wall, the sling being suspended freely from the junctures in dependent relation and having a lower extremity spaced apart above bottom edges of the panels of the front and rear walls so as to enable elastic displacement of the sling toward the bottom wall of the main receptacle.

14. The computer carrying case according to claim 11 wherein the means for adjustably connecting the right and left ends of the front and rear walls to each other includes at each of the right and left ends a zippered gusset joining the front and rear walls.

15. The computer carrying case according to claim 12 wherein each zippered gusset includes a pair of strips of flexible material, one of which is joined along one edge to the end of the front wall and the other of which is joined along one edge to the end of the rear wall, and a zipper releasably joining the other edges of each strip to each other.

16. The computer carrying case according to claim 12 wherein each of the strips has a lower edge that is fastened to the end wall of the computer receptacle in spaced-apart relation to the lower edge of the end wall and a lower portion of each strip is wider than an upper portion so that when the zipper is released the lower portion of the compartment expands to substantially the same extent as the upper portion.

17. The computer carrying case according to claim 11 wherein the means for adjustably connecting the ends of the side walls to each other includes a flexible tab joined to each end of each of the front and rear walls intermediate the top and bottom edges of the front and rear walls and a releasable fastener having one coupling element on two of the tabs and another coupling element on the remaining two tabs.

18. The computer carrying case according to claim 11 wherein the means for adjustably connecting the left and right ends of the front and rear walls to each other includes at each of the right and left ends a flexible cord trained along a predetermined path in coupled relation to the front and rear walls.

19. The computer carrying case according to claim 11 wherein the means for adjustably connecting the right and left ends of the front and back walls to each other includes at each end a buckle on one of the front and rear walls and a tab on the other of the front and rear walls that is releasably engageable with the buckle in a plurality of selected positions.

* * * * *